US006546686B2

(12) United States Patent
MacKarvich

(10) Patent No.: US 6,546,686 B2
(45) **Date of Patent: *Apr. 15, 2003**

(54) BALANCED STABILIZATION SYSTEM

(76) Inventor: Charles J. MacKarvich, 3940 Paces Manor Dr., Atlanta, GA (US) 30339

( * ) Notice: Subject to any disclaimer, the term of this patent is extended or adjusted under 35 U.S.C. 154(b) by 161 days.

This patent is subject to a terminal disclaimer.

(21) Appl. No.: 09/772,547

(22) Filed: Jan. 30, 2001

(65) Prior Publication Data

US 2002/0170253 A1 Nov. 21, 2002

Related U.S. Application Data

(63) Continuation-in-part of application No. 09/296,992, filed on Apr. 22, 1999, now Pat. No. 6,282,856, which is a continuation-in-part of application No. 09/123,806, filed on Jul. 27, 1998, now Pat. No. 6,058,663, which is a continuation-in-part of application No. 08/739,717, filed on Oct. 29, 1996, now Pat. No. 5,850,718, which is a continuation-in-part of application No. 08/644,069, filed on May 9, 1996, now Pat. No. 5,784,844, which is a continuation-in-part of application No. 08/629,834, filed on Apr. 10, 1996, now Pat. No. 5,697,191.

(51) Int. Cl.[7] ..... E02D 27/42

(52) U.S. Cl. ..... 52/299; 52/125.6; 52/16.11; 248/188.1; 248/680; 248/681

(58) Field of Search ..... 52/294, 295, 169.9, 52/299, 126.6, DIG. 11; 248/188.1, 499, 500, 680, 681

(56) References Cited

U.S. PATENT DOCUMENTS

| | | | | |
|---|---|---|---|---|
| 187,337 A | | 2/1877 | Wing et al. | |
| 709,300 A | | 9/1902 | Buchtel | |
| 3,599,380 A | | 8/1971 | Menzi | 52/155 |
| 3,750,349 A | | 8/1973 | Dieke | 52/23 |
| 3,830,024 A | | 8/1974 | Warnke | 52/23 |
| 4,258,514 A | | 3/1981 | St. Clair | 52/86 |
| 4,261,149 A | | 4/1981 | Gustafson | 52/292 |
| 4,417,426 A | | 11/1983 | Meng | 52/126.7 |
| 4,882,887 A | * | 11/1989 | Giles et al. | 248/228.1 |
| 5,359,821 A | | 11/1994 | Merriman | 52/169.9 |
| 5,363,610 A | * | 11/1994 | Thomas et al. | 52/126.6 |
| 5,509,237 A | * | 4/1996 | Coulter | 248/357 |
| 5,630,303 A | * | 5/1997 | Devenish, III | 248/346.01 |
| 5,697,191 A | | 12/1997 | MacKarvich | 52/169.9 |
| 5,752,691 A | * | 5/1998 | Bashon et al. | 256/1 |
| 5,758,460 A | | 6/1998 | MacKarvich | 52/292 |
| 5,784,844 A | | 7/1998 | MacKarvich | 52/292 |
| 5,870,866 A | * | 2/1999 | Herndon | 52/126.6 |
| 5,873,679 A | * | 2/1999 | Cusimano | 405/229 |
| 6,015,138 A | * | 1/2000 | Kohlberger et al. | 256/65.14 |
| 6,058,663 A | | 5/2000 | MacKarvich | 52/167.3 |
| 6,240,683 B1 | * | 6/2001 | Byrd | 52/169.9 |
| 6,334,279 B1 | * | 1/2002 | Oliver et al. | 248/354.3 |
| 6,347,489 B1 | * | 2/2002 | Marshall et al. | 248/354.5 |
| 6,381,907 B1 | * | 5/2002 | MacKarvich | 52/105 |
| 6,418,685 B1 | * | 7/2002 | Oliver et al. | 248/354.3 |

FOREIGN PATENT DOCUMENTS

| | | | |
|---|---|---|---|
| JP | 5-255940 | * 10/1993 | E02D/27/14 |

* cited by examiner

*Primary Examiner*—Lanna Mai
*Assistant Examiner*—Chi Q. Nguyen
(74) *Attorney, Agent, or Firm*—Thomas, Kayden, Horstemeyer & Risley

(57) ABSTRACT

The stabilization system includes a foundation platform (16) that supports a pier (18), with the pier in turn supporting the joists (12) of a premanufactured building structure (10). Cleat walls (25–28) at the edges of the central body portion of the foundation platform extend into the ground. Struts (46, 47) are sloped upwardly from the foundation platform for connection to an adjacent joist. The weight of the building structure and the cleat walls prevent the foundation platform from horizontal movement. Thus, horizontal movement of the building structure is resisted without the application of horizontal forces to the pier.

26 Claims, 7 Drawing Sheets

BALANCED STABILIZATION SYSTEM

CROSS REFERENCE

This is a continuation-in-part of U.S. patent application Ser. No. 09/296,992 filed Apr. 22, 1999, now U.S. Pat. No. 6,282,856, issued Sep. 4, 2001; which is a continuation-in-part of U.S. patent application Ser. No. 09/123,806 filed Jul. 27, 1998, now U.S. Pat. No. 6,058,663 issued May 9, 2000; which is a continuation-in-part of U.S. patent application Ser. No. 08/739,717 filed Oct. 29, 1996, now U.S. Pat. No. 5,850,718 issued Dec. 22, 1998; which is a continuation-in-part of U.S. patent application Ser. No. 08/644,069 filed May 9, 1996, now U.S. Pat. No. 5,784,844 issued Jul. 28, 1998; which is a continuation-in-part of U.S. patent application Ser. No. 08/629,834 filed Apr. 10, 1996, now U.S. Pat. No. 5,697,191 issued Dec. 16, 1997.

FIELD OF THE INVENTION

This invention relates generally to a foundation system for a premanufactured building that is supported above the ground on a plurality of piers, with the piers supporting two or more horizontally extending parallel joists of the building. More particularly, the invention relates to a stabilization system for the foundation for such a building.

BACKGROUND OF THE INVENTION

Premanufactured building structures such as mobile homes, trailers, prefabricated houses and the like are manufactured at a central manufacturing site, and upon completion the structures are moved to a location where they are to be permanently located and occupied. Because the typical manufactured structure is designed to be easily moved from the site where it is manufactured to its permanent location, the structure is not originally built upon a permanent foundation at the manufacturing site. Rather, the structure typically is constructed upon a pair of parallel, horizontally extending I-beam joists. The joists are displaced inwardly from the opposing side walls of the manufactured structure, and temporary wheels are attached to the joists so that the manufactured structure can be transported over public highways to its installation site, where the structure likely will be mounted on piers, such as concrete blocks, pilings, or stabilizing jacks. It is important that the structure be anchored in position on the piers, typically with the use of ground anchors and ties extending from the ground anchors to the joists or other framework of the structure, so as to avoid the structure being shifted off of its piers by strong winds or seismic action. Serious damage to the manufactured structure and even human injury can occur if a structure is inadvertently shifted off of its piers or tilted over.

Various types of stabilizing devices have been used to stabilize such manufactured structures, to keep the structures from moving in response to wind forces and earth movement. The vertical support for the manufactured structure usually is provided by the piers located under the parallel joists of the main frame of the structure, with the piers being spaced longitudinally along the parallel joists at approximately 8 feet intervals. The piers typically are placed upon flat planar foundation platforms each having a much larger surface area than the pier itself and which stabilizes the pier at its interaction with the ground surface.

Lateral and upward movement off of the piers is resisted by tie down straps that tie the support joists of the structure to ground fixtures or to ground anchors that are either permanently or temporarily inserted into the ground. A traditional approach to providing wind storm protection for manufactured structures includes a ground anchor having a shank with one or more helical plates at the bottom of the shank that can be rotated to move the anchor into the ground, and cold rolled steel strapping installed as a diagonal tie between the anchor head and the lower main frame of the manufactured structure. Anchors of this type are taught in U.S. Pat. Nos. 5,758,460; 5,697,191; 5,784,844; and 5,850,718.

While the foregoing stabilizing systems have been successful in reliably tying down manufactured structures, the prior art systems continue to need improvement to provide inexpensive and easy to install and safe stabilization systems to avoid the buildings from shifting laterally and/or longitudinally off of their piers. It is believed that if movement of the building structure with respect to the piers can be avoided, most of the problems of supporting the building structure can be avoided.

It is to the above noted problem that this invention is directed.

SUMMARY OF THE INVENTION

Briefly described, the present invention provides a stabilization system for the foundation of a premanufactured building structure that braces the joists of the building structure with respect to foundation platforms placed beneath the building structure. Each foundation platform typically supports a pier, with the lower end portion of the pier being mounted on a foundation platform and the upper portion of the pier being placed in supporting relationship with respect to a supporting joist of the building structure. In this manner, the weight of the building structure is applied downwardly through the pier to the foundation platform and distributed through the foundation platform to the ground beneath the platform. Thus, the weight of the building structure stabilizes the foundation platform.

One or more diagonally extending struts are connected between the foundation platform and a joist of the building, with each strut connected at its lower end to the foundation platform and sloped upwardly from the foundation platform and adapted for connection at its upper end to a joist of the building structure. The weight of the building structure and the shape of the foundation platform keep the foundation platform from moving in response to the diagonal forces applied to the foundation platform by the strut.

Each diagonal strut is arranged with respect to the foundation platform so as to apply the forces of compression received from the joists of the building structure in a direction sloped downwardly to the foundation platform. These forces are stabilized with the weight of the building as applied to the foundation platform, so as to spread the sum of the forces across the foundation platform. The weight of the building applied to the foundation platform and the configuration of the foundation platform are sufficient to avoid lateral movement, tilting and turning of the foundation platform in response to the diagonal forces applied by the diagonal struts.

In a preferred embodiment, the foundation platform includes a body portion that is to be applied against the ground beneath the building structure. Panels extending from opposed edges of the body portion and angled with respect to the body portion form cleats that extend into the ground at the edges of the body portion. While the cleats may take several configurations, a preferred embodiment of the cleats is that the cleats are formed as walls so as to have large cross-sectional areas that have the potential of laterally engaging the ground beneath the body portion of the foundation platform.

When the foundation platforms are placed on the ground, at least one of the cleat walls of the foundation platform is oriented transversely with respect to the length of the strut. When the strut applies its diagonal force against the foundation platform, the transverse cleat walls resist horizontal movement of the foundation platform and the ground resists vertical movement, thereby resisting the force of the strut. This, in turn, resists the movement of the joist to which the upper end of the strut is connected, thereby stabilizing the foundation system and, in turn, the building structure. This is accomplished without applying horizontal forces against the pier.

Because it is desirable to construct the pier of inexpensive materials, such as concrete blocks, a typical pier is strong in a vertical dimension in that it can hold large weights, but is relatively weak in horizontal force resistant properties. Therefore, the invention disclosed herein avoids applying horizontal forces to the pier, enabling the builder to utilize less expensive materials in the pier.

In one embodiment of the invention, the lower end portion of the strut is mounted to the foundation platform at a position equidistant between the opposed transverse cleat walls. With this arrangement the forces applied through the strut to the foundation platform are more equally applied to the opposed transverse cleat walls, avoiding tilting and turning of the foundation platform.

Other embodiments of the invention employ two struts having their lower ends placed in straddling relationship with respect to the pier mounted on the foundation platform, on opposite sides of the position where the weight of the building is applied to the foundation platform. Again, this tends to balance the load applied to the foundation platform, with the weight of the building being applied to the central portion of the platform, thereby avoiding the tilting, turning and/or deterioration of the foundation platform in response to the diagonal forces of compression being applied thereto by the diagonal struts.

Other embodiments of the invention include struts mounted at their respective lower ends to the foundation platform in relationships where the forces applied through the struts to the foundation platform are equally distributed in the foundation platform. The struts can be sloped upwardly in various directions to the same joist of the building structure that is supported by the pier or to adjacent ones of the joists.

In the preferred embodiment of the invention, the foundation platform is fabricated of a single piece of sheet material, preferably high grade steel. The foundation platform includes a centrally positioned rectangular flat body portion arranged for placement in flat abutment with the ground, and cleat walls extending from the edges of the body portion and turned toward the ground for extending downwardly into the ground. The cleat walls avoid horizontal movement of the foundation platform in response to the forces applied thereto by the struts and the joists of the building structure while the weight of the building applied to the central body portion avoids vertical movement.

Typically, the improved stabilization system described herein is combined with ground anchors and tie down straps and other conventional equipment needed to avoid lifting of the building structure off the piers and lateral movement of the building structure.

Therefore, it is an object of the present invention to provide an improved stabilization system for the foundation of a premanufactured building structure that is easy to install, inexpensive to produce, and which provides improved stabilization to the building structure.

Another object of this invention is to provide an improved stabilization system for premanufactured building structures that provide resistance to horizontal movement of the building structure with respect to the piers that support the building structure, without applying horizontal forces to the piers themselves.

Another object of this invention is to provide an improved foundation system for a premanufactured building structure that utilizes a foundation platform positioned on the ground with piers mounted thereon, and with struts extending diagonally from the building structure downwardly to the support platforms, with the weight of the building and the configuration of the foundation platform resisting horizontal movement of the building structure.

Another object of the invention is to provide an improved foundation for a premanufactured building structure that utilizes the weight of the building structure to retard horizontal movement of the building.

Other objects, features and advantages of this invention will become apparent upon reading the following specification, when taken in conjunction with the accompanying drawings.

DETAILED DESCRIPTION

Figure 1:
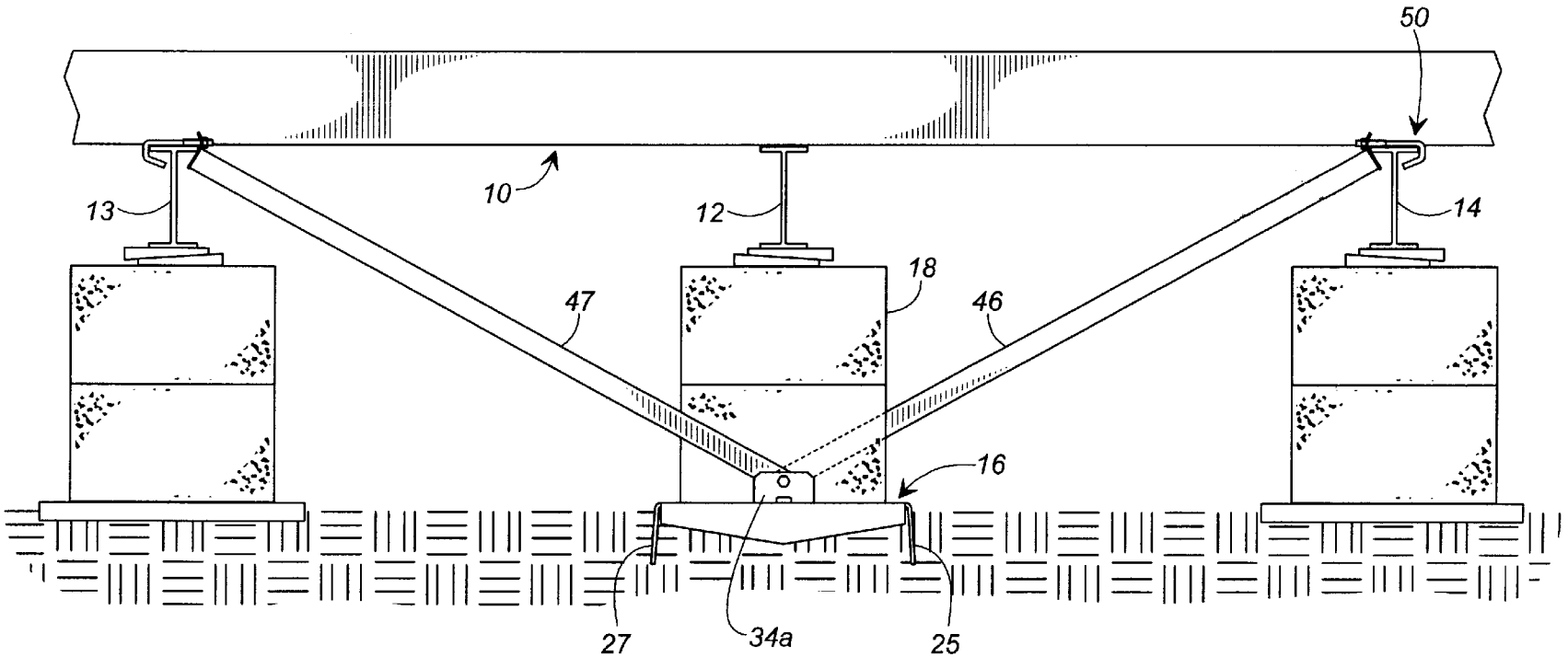
FIG. 1 is a partial end elevational view of a "double wide" premanufactured building structure, showing a pier assembly having a foundation platform, a pier mounted thereon, and the pier in supporting relationship with respect to a joist of the structure, and struts extending upwardly from the foundation platform to adjacent joists.

As illustrated in FIG. 1, a premanufactured building structure 10 includes parallel, horizontally extending support joists 12, 13 and 14, with the building structure being mounted on and supported by the support joists. The support joists are each mounted on pier assemblies. The centrally positioned pier assembly includes foundation platform 16 and pier 18. The pier 18 can be formed of various conventional pier structures, such as stacked concrete blocks, jack stands, and other devices that are able to bear a heavy vertical load.

Figure 7:
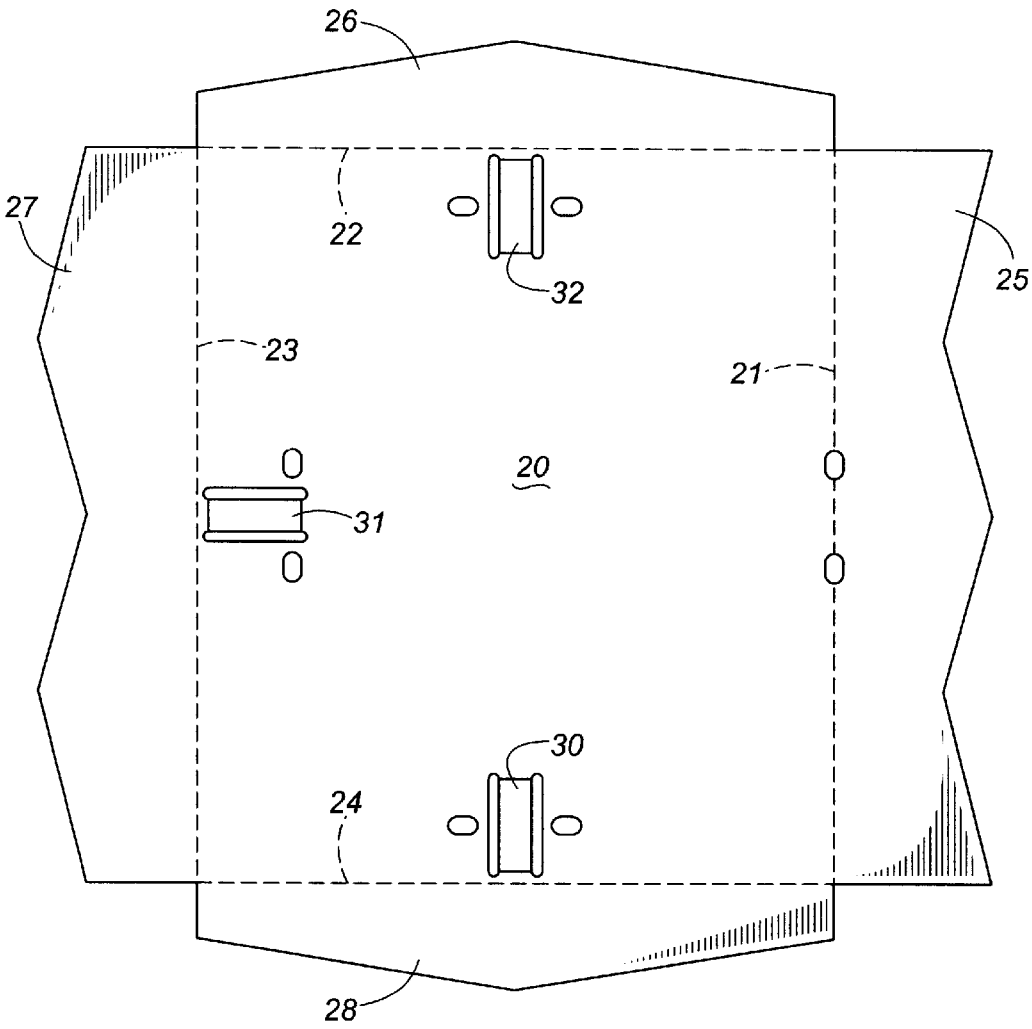
FIG. 7 is a layout view of a foundation platform after it has been cut to shape but before its side panels have been bent with respect to the body portion to form the cleat walls.
Figure 9:
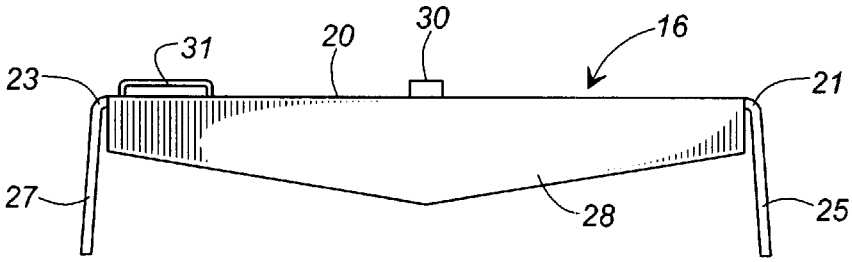
FIG. 9 is an end elevational view of the foundation platform of FIG. 8.
Figure 8:
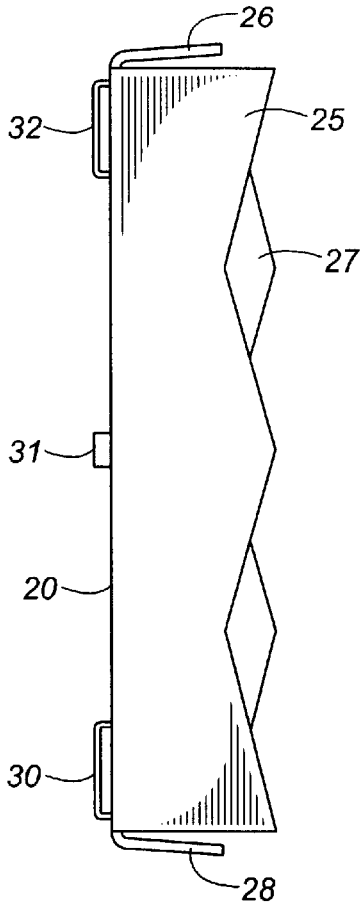
FIG. 8 is a side elevational view of the foundation platform with the cleat walls having been formed.
Figure 12:
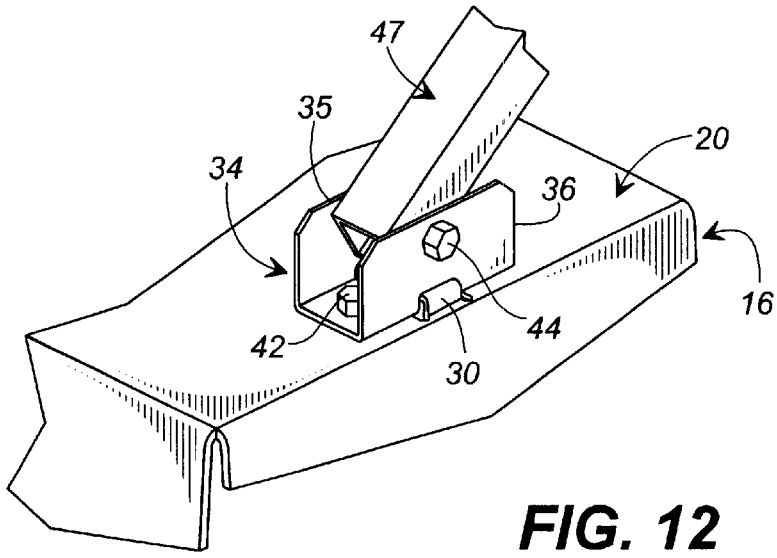
FIG. 12 is a perspective illustration of the platform connector showing the connection made between the lower end of a strut and the body portion of a foundation platform.

As best illustrated in FIGS. 7-9, foundation platform 16 is formed from a single sheet of material, such as sheet steel of the type that is resistive of corrosion, or other suitable strong sheet material. In its cut but unformed flat shape as illustrated in FIG. 7, the foundation platform 16 includes a central body portion 20 with the body portion defining fold lines at its edge portions 21, 22, 23 and 24. Edge panels 25, 26, 27 and 28 extend from the edge portions 21–24, respectively. The edge panels 25–28 are folded with respect to the flat body portion 20 to an angle approximately perpendicular to the body portion 20, but with a slight taper so as to allow stacking of the foundation platforms in a nested configuration. When the panels 25–28 are folded as illustrated in FIGS. 8, 9 and 12, they function as cleat walls about the perimeter of the body portion 20. The cleat walls are serrated along their lower edges for ease of entry into the ground.

Body portion 20 preferably is flat so that it can rest flat upon the ground with the cleat walls 25–28 extending into the ground. The upper surface of the body portion is flat and therefore suitable for receiving the lower end portion of a pier, such as pier 18 of FIG. 1. However, various strengthening ribs or other strengthening features (not shown) can be formed in the body portion 20 for the purpose of strengthening the body portion without disrupting the ability of the body portion to function as described above.

U-shaped braces 30, 31 and 32 are struck from the material of the central body portion 20 of the foundation platform. The U-shaped braces 30–32 are utilized for mounting the lower ends of the struts to the foundation platform 20, as will be described in more detail hereinafter.

Figure 10:
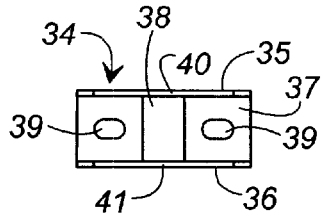
FIG. 10 is a plan view of a platform connector.
Figure 11:
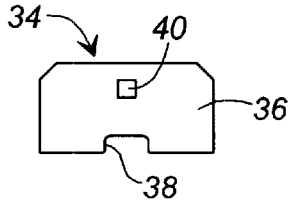
FIG. 11 is a side view of the platform connector of FIG. 10.

As illustrated in FIGS. 10, 11 and 12, platform connectors 34 are provided for mounting the lower ends of the sloped struts, such as struts 46 and 47, to the foundation platforms 20. The platform connectors are approximately U-shaped in cross-section, having parallel side walls 35 and 36 and base wall 37. A slot 38 is formed in the base wall 37, extending upwardly for a short distance in side walls 35 and 36. Connector openings 39 straddle slot 38. Side walls 35 and 36 define aligned connector openings 40 and 41.

As illustrated in FIG. 12, the slot 38 of each platform connector 34 is placed about a U-shaped brace 30–32 so as to accurately position the platform connector on the foundation platform 20. Screws 42 are threaded through the openings 39 of the connectors and into the material of the central body portion 20 of the foundation platform, thereby securely and permanently mounting the platform connectors to the foundation platform. The lower ends of the diagonal struts 46 and 47 are positioned between the parallel side walls 35 and 36 of the platform connectors and bolts 44 are extended through the aligned openings 40 and 41 of the platform connector and the aligned openings (not shown) in the lower end of the struts (FIG. 12).

Figure 2:
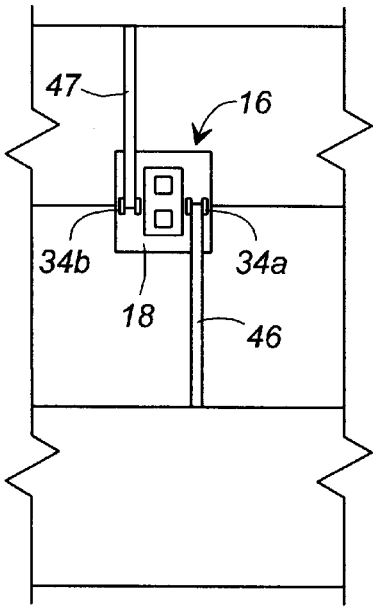
FIG. 2 is a schematic plan view of the building structure of FIG. 1.

As illustrated in FIGS. 1 and 2, diagonal struts 46 and 47 are extended from the foundation platform 16 and are sloped upwardly for connection to an adjacent joist, such as to joists 13 and 14. In the embodiment illustrated in FIGS. 1 and 2, the strut 46 is mounted to a platform connector 34*a* on one side of the foundation platform 16, while the strut 47 is mounted to the platform connector 34*b* on the other side of the foundation platform. The lower ends of the struts straddle the pier 18.

Figure 13:
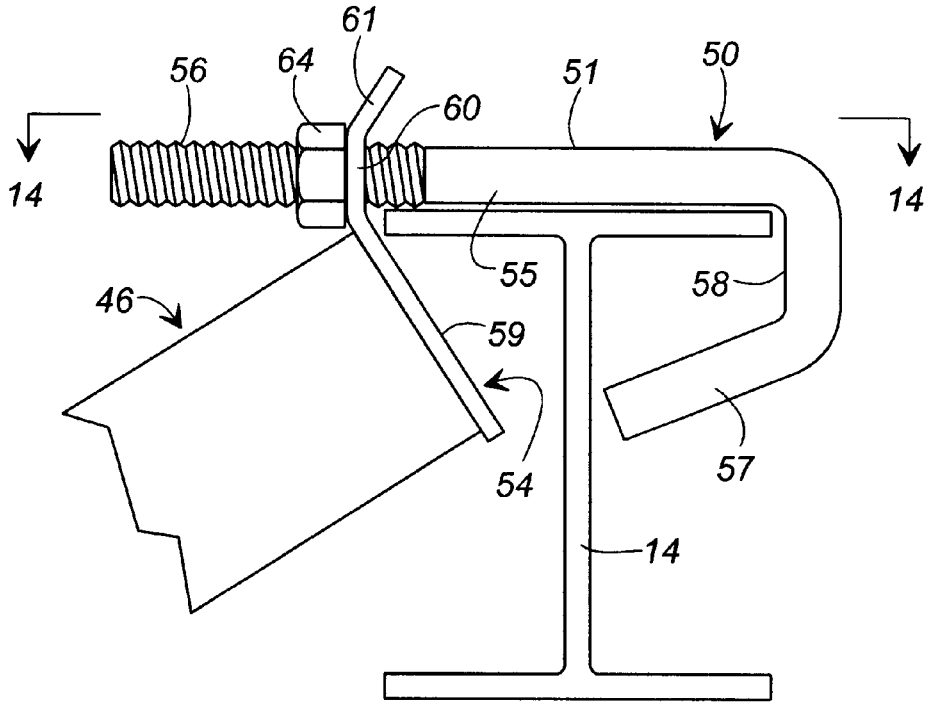
FIG. 13 is a side view of the joist connector.
Figure 14:
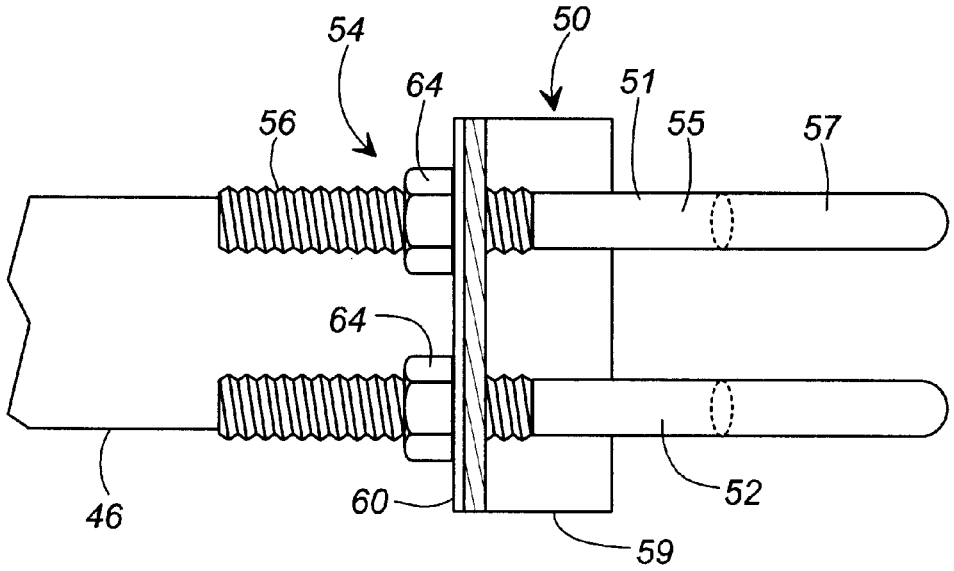
FIG. 14 is a plan view of the joist connector of FIG. 13.

The upper end of the struts 46 and 47, when mounted to an adjacent joist, such as to joists 13 and 14, are connected to the joist by means of adjustable clamp 50. Clamp 50, as shown in FIGS. 1, 13 and 14, includes a pair of J-shaped connectors 51 and 52 oriented parallel to each other, and connector plate 54. The J-shaped connectors each include a stem 55 that is helically threaded at one end 56 and is J-shaped at its distal end 57. The J-shaped end 57 is sized and shaped so as to hook around the upper flange of the I-beam joist, such as joist 14. The J-shaped end has a rectilinear segment 58 for forming an adjustable fit about the joist.

Connector plate 54 is formed in angled segments: strut connector segment 59, connector segment 60, and strengthening segment 61. Connector segment 60 defines a pair of holes extending therethrough so that the J-shaped connectors 51 and 52 can extend through the holes and internally threaded nuts 64 are threaded onto the threads 56 of the connectors 51 and 52. This draws the connector plate 54 toward the I-beam joist 14, capturing the upper flange of the I-beam joist in the adjustable clamp 50.

The upper end of the strut 46 is welded to strut connector segment 59 of the connector plate 54.

It can be seen that if the strut 46 is not aligned perfectly as illustrated in FIG. 13, so that its stem 55 is not parallel to the upper surface of the upper flange of the I-beam joist 14, the substantially rectilinear breadth 58 of the J-shaped distal end 57 of the connector will permit tilting of the adjustable clamp 50 with respect to the joist, so as to avoid the application of twisting forces to the joist.

As can be understood from its description, the adjustable clamp 50 functions as a joist connector for mounting the upper end of a strut to a joist, so that the upper end of the strut is adapted to be connected to a joist.

FIGS. 1 and 2 illustrate the stabilization system when two outboard joists are stabilized from a foundation platform and its pier of a centrally positioned joist. One of the struts 46 is mounted at its lower end to the foundation platform 16 on the far side of the pier 18, while the other of the struts 47 is mounted at its lower end to the foundation platform on the near side of the pier. Both of the struts 46 and 47 are connected to the platform connectors 34, which in turn are mounted to the central body portion of the foundation platform 16, substantially equidistant from the transversely extending cleat walls 25 and 27, or at least in the middle one-third of the distance between the opposed cleat walls.

With this arrangement, should there be a force applied by a support joist, such as joist 14, along the length of the strut 46 to the platform connector 34 and to the foundation platform 16, the force applied is transmitted to a portion of the foundation platform that is substantially equidistant between the transversely extending cleat walls 25 and 27. This tends to equalize the horizontal forces applied to the cleat walls 25 and 27, and avoids the tendency of the horizontal forces to tilt the foundation platform. Additionally, the weight of the building structure applied through the pier to the foundation platform holds the cleats in the ground.

Figure 3:
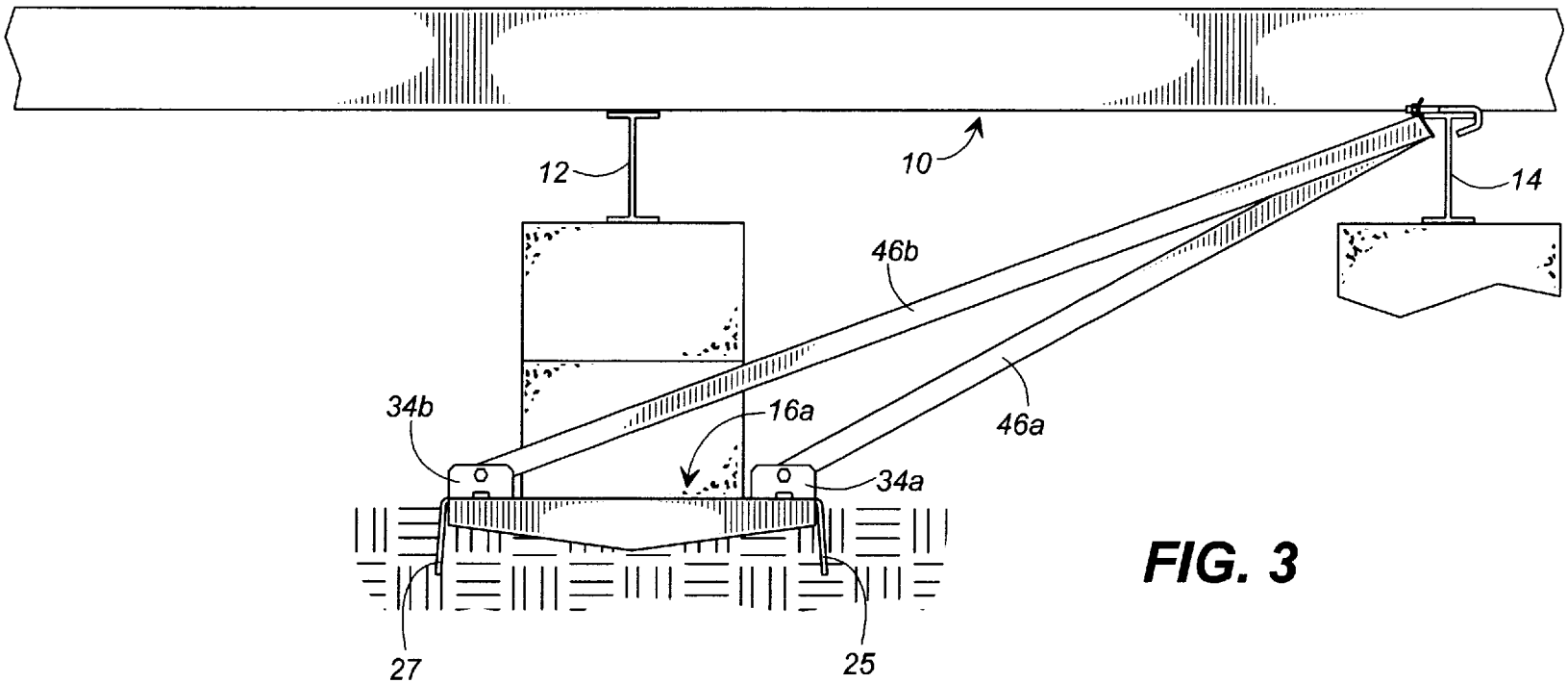
FIG. 3 is a partial end elevational view of a premanufactured building structure, similar to FIG. 1 but which can be either a "single wide" or "double wide" structure, showing a modified arrangement of the connection of struts to the foundation platform.

As illustrated in FIG. 3, when only two joists support the manufactured structure 10, the struts, such as 46*a* and 46*b*, can be attached by welding to the joist connector 50, and the platform connectors 34*a* and 34*b* positioned adjacent the opposed, transversely extending cleat walls 25 and 27, thereby equalizing the compressive forces applied from the joist 14 through the struts 46*a* and 46*b*, through the platform connectors 34*a* and 34*b*, to the foundation platform 16*a*. This equalization of forces tends to avoid the tilting of the foundation platform in the ground beneath the building structure.

Figure 4:
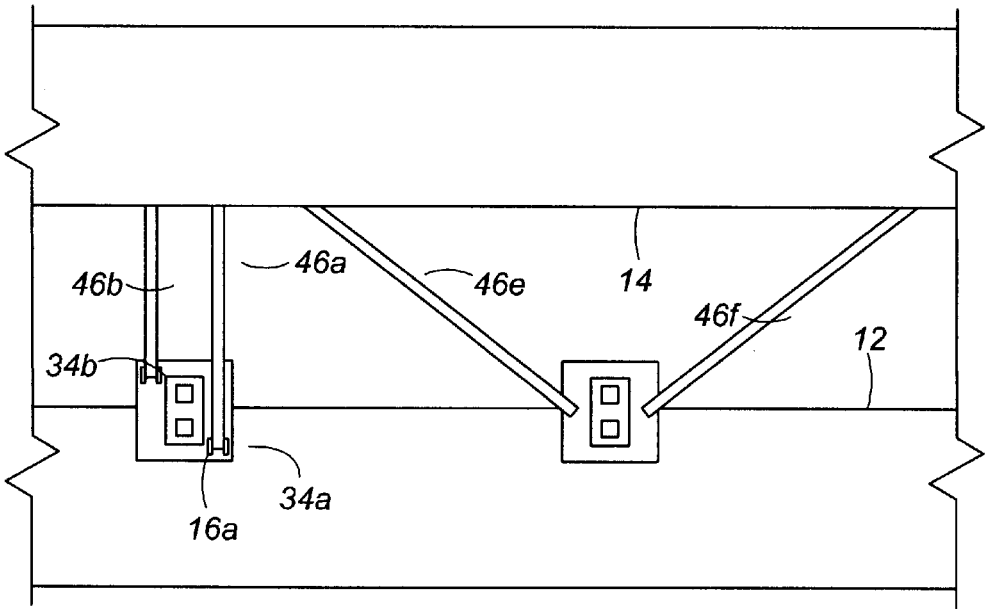
FIG. 4 is a schematic plan view of FIG. 3, showing the arrangement of the struts.

FIG. 4 illustrates the struts 46*a* and 46*b* extending in vertical planes oriented at right angles with respect to the joists and struts 46*e* and 46*f* extending in vertical intersecting planes.

It should be noted that embodiments of FIGS. 1–4 illustrate that the lower end portions of the struts are positioned in straddling relationship with respect to the pier, so that the weight of the building is applied between the lower ends of the struts to the foundation platform, thereby tending to balance the forces applied to the foundation platform, with the weight of the building being prominently applied in a stabilizing manner to the central portion of the foundation platform.

Figure 6:
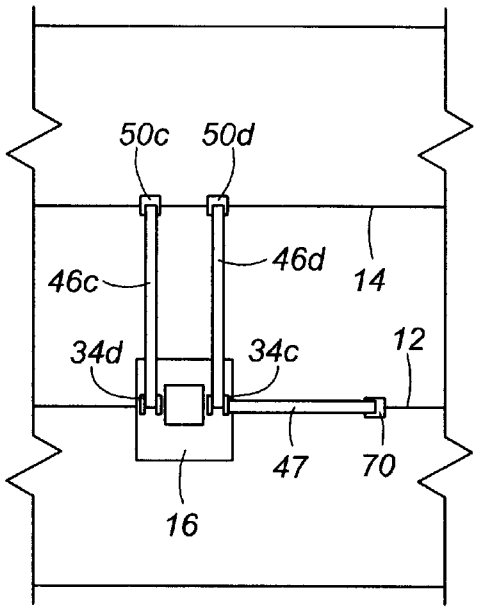
FIG. 6 is a plan view of the stabilization system of FIG. 5.
Figure 5:
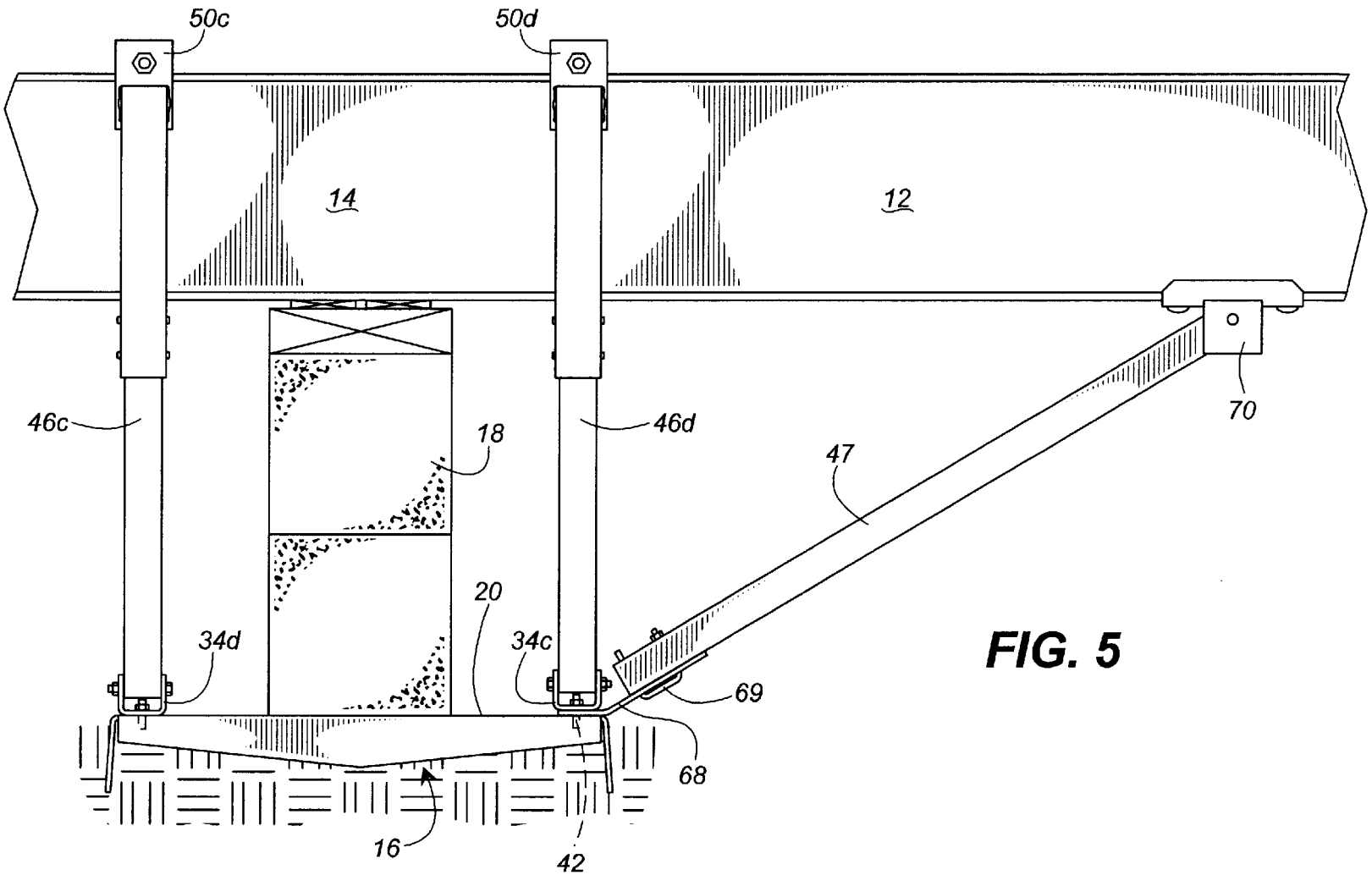
FIG. 5 is a partial side elevational view of a premanufactured building structure, showing the structure mounted on a pier and a foundation platform, with struts extending to the same joist that is mounted on the pier and to an adjacent joist.

FIGS. 5 and 6 illustrate a combination of struts that extend to the support joist of the pier and to an adjacent support joist. The platform connectors 34*c* and 34*d* are mounted in a manner similar to that of FIG. 1 on opposite sides of the pier 18, and adjustable length struts 46*c* and 46*d* are mounted at their lower ends to the platform connectors, and are sloped upwardly toward the adjacent joist 14. The joist connector 50*c* and 50*d* connect the upper ends of the struts to the upper flange of the support joist 14.

Also, angled connector 68 is mounted between platform connector 34*c* and the central body portion 20 of the foundation platform 16 with a screw 42. The angled connector 68 supports the lower end portion of the strut 47 with a U-shaped bolt 69, and a conventional beam clamp 70 connecting the upper end of the strut to the joist 12.

The configuration of FIGS. 5 and 6 show the versatility of the stabilization system, in that the foundation platform can be connected to the same joist that is supported by the pier on the platform, and can also be connected to the adjacent joist. Since the foundation platform 16 has cleat walls on all four edges, with opposed edges being oriented transverse to the struts, the joists 12 and 14 of the building structure are horizontally stabilized, both longitudinally and laterally of the building structure, by the single foundation platform 16. Additionally, the stabilization is accomplished without applying horizontal stress to the pier 18, enabling the pier to be formed of concrete blocks and other materials that provide vertical compressive strengths but significantly less horizontal compressive strengths.

While the weight of the building is disclosed as being applied to the foundation platform through a pier positioned centrally on the central body portion of the foundation platform with the forces of the struts being applied to the sides of the pier, it is possible to use a jack stand as a pier or some other pier construction in which the weight of the building structure is spread about the central body portion of the foundation platform and the struts are applied to the central body portion of the platform, between the legs of the pier.

Although preferred embodiments of the invention have been disclosed in detail herein, it will be obvious to those skilled in the art that variations and modifications of the disclosed embodiments can be made without departing from the spirit and scope of the invention as set forth in the following claims.

What is claimed is:

1. A stabilization system for a premanufactured building structure that includes at least one joist supported horizontally above the ground, comprising:

a foundation platform for positioning on the ground beneath the building structure, a strut having a length sloped upwardly from said foundation platform for connection to a joist of the building structure and having an upper end for positioning adjacent the joist and a lower end positioned adjacent said foundation platform, a joist connector adapted to rigidly connect said upper end of said strut to the joist of the building structure, a platform connector rigidly connecting said lower end of said strut to said foundation platform, the improvement therein comprising:

said foundation platform being formed of sheet material and including a substantially flat central body portion for placement on the ground, said foundation platform having opposed edge portions extending transverse to the length of said strut and cleats extending from said opposed edge portions and extending from said opposed edge portions at an angle from said body portion and adapted to penetrate the ground at said foundation platform, and said platform connector mounted to said body portion of said foundation platform at a position that balances the forces applied by said strut on said cleats at said opposed edge portions of said foundation platform, so that the compression forces transmitted through the strut from the joist to the foundation platform are resisted by the cleats substantially without the tendency of tilting said foundation platform.

2. The stabilization system of claim 1, wherein the building structure includes two parallel joists, and said foundation platform and pier are adapted to be positioned beneath one of said joists and said strut is adapted to extend sloped upwardly from said foundation plate to the other of said joists.

3. The stabilization system of claim 1, wherein said foundation platform is adapted to be positioned beneath the joist of the building and said strut slopes upwardly from said foundation platform to the joist.

4. The stabilization system of claim 1, and further including a pier including a lower end portion mounted on said foundation platform and an upper end portion adapted to support the weight of the building structure so that the weight of the building structure rests on said foundation platform.

5. The stabilization system of claim 1, wherein said strut comprises a pair of struts straddling said pier.

6. The stabilization system of claim 1, wherein said platform connector is mounted to said body portion of said foundation platform at a position between one-third the distance from said opposed edge portions.

7. The stabilization system of claim 1, wherein said cleats comprise said foundation platform including edge panels positioned on opposed sides of said body portion and formed at an angle with respect to said body portion to form cleat walls for extending into the ground.

8. The stabilizing system of claim 7, wherein said cleat walls are oriented transversely to the length of said strut.

9. The stabilization system of claim 1, wherein said strut comprises struts extending upwardly at opposed diverging angles from said foundation platform.

10. A stabilization system for a premanufactured building structure that includes at least one joist supported horizontally above the ground, comprising:

a foundation platform for positioning on the ground beneath the building structure, a pier including a lower end portion mounted on said foundation platform and an upper end portion adapted to engage the joist and support the weight of the building structure so that the weight of the building structure rests on the foundation platform, the improvement therein comprising;

said foundation platform having a body portion for receiving said pier and opposed edges, and cleat walls extending from said opposed edges at an angle with respect to said body portion for extending into the ground at said support platform, a strut having a length extending transverse to said cleat walls and sloped upwardly from said foundation platform and having a lower end portion mounted to said foundation platform at a position approximately equally intermediate said cleat walls and an upper end adapted to be mounted to the joist of the building structure, so that the forces of compression applied from the joist of the building through the strut to the support platform avoid tilting and turning of the support platform.

11. The stabilization system of claim 10, wherein said strut comprises at least two struts each sloped upwardly in opposed directions from said foundation platform.

12. The stabilization system of claim 11, wherein said struts are mounted to said foundation platform on opposed sides of said pier.

13. A stabilization system for a premanufactured building structure of the type including a pair of parallel, horizontally extending support joists, said stabilization system comprising:

a foundation platform having a body portion for placement on the ground beneath the building structure, said foundation platform having cleat walls extending from said body portion approximately normal to said body portion for penetrating the ground, a strut having a length sloped upwardly from said body portion and having a lower end portion for connection to said foundation platform and an upper end for connection to a support joist of the building structure, a joist connector adapted for connecting said upper end of said strut to a support joist of the building structure, a platform connector connecting said lower end of said strut to said body portion of said foundation platform, said platform connector mounted to said body portion of said foundation platform between one-third and two thirds of the distance between said cleat walls of said foundation platform, and said cleat walls of said foundation platform extending transverse to said strut, so that the forces of compression applied through said strut to said foundation platform have a reduced tendency to tilt the foundation platform.

14. The stabilization system of claim 13, and further including a pier having a lower end portion mounted on said body portion of said foundation platform and an upper end portion adapted to support a joist of the building structure, so that the weight of the building is applied to through said pier to the foundation platform.

15. The stabilization system of claim 13, wherein said platform connector is mounted to said body portion of said foundation platform at a position approximately one-half the distance between said cleat walls.

16. The stabilization system of claim 13, wherein said foundation platform is formed of sheet metal.

17. The stabilization system of claim 13, wherein said joist connector is a j-shaped hook adapted for extending about a joist of the building.

18. A stabilization system for a premanufactured building structure of the type having a pair of parallel support joists extending horizontally above the ground, said stabilization system comprising:

a foundation platform for placement on the ground beneath the building structure, at least on strut having a length sloped upwardly from said foundation platform to a joist of the building structure, with a lower end mounted to said foundation platform and an upper end adapted to be mounted to the joist of the building structure, the improvement therein of said foundation platform being formed of sheet material and including a substantially flat body portion with opposed edges, said body portion adapted to rest against the ground, and panels at said opposed edges formed at an angle to said body portion forming opposed cleat walls extending approximately parallel to each other from said foundation platform and extending into the ground, said cleat walls extending transverse to the length of said strut, and support straps struck from said body portion adapted for mounting said strut to said body portion of said foundation platform.

19. A foundation platform for supporting a pier of a premanufactured building structure, wherein the weight of a building structure is applied to the foundation platform and horizontal forces are applied to the foundation platform by diagonal struts extending between the foundation platform and the building structure, said foundation platform comprising:

a central body portion having opposed edges, said central body portion being substantially flat and adapted for lying flat on the surface of the ground and bearing the weight of a building structure, cleat walls extending from said opposed edges at an angle with respect to said central body portion for extending into the ground about said body portion, and connector braces formed in said central body portion of said foundation platform sized and shaped for mounting struts to said central body portion.

20. The foundation platform of claim 19, wherein said central body portion of said foundation platform is rectangular and has edges formed thereabout at right angles with respect to each other, and said cleat walls extend from said edges.

21. The foundation platform of claim 20, wherein said cleat walls extend from said central body portion at a substantially right angle.

22. The foundation platform of claim 19, wherein said cleat walls are formed so that said foundation platforms are stackable in nested arrangements.

23. The foundation platform of claim 19, wherein said connector braces are u-shaped and are struck from said central body portion.

24. The foundation platform of claim 19, wherein said cleat walls are serrated for ease of penetration into the ground.

25. A stabilization system for a premanufactured building structure having parallel horizontally extending support joists positioned above the ground, said stabilization system comprising:

a foundation platform including a substantially flat central body portion for flat engagement with the ground beneath the building structure and cleat walls extending at an angle from said central body portion for extending into the ground, a pier having a lower portion mounted on said central body portion of said foundation platform and an upper portion adapted for supporting a joist of the building structure, so that the weight of the building structure is applied through the pier to the foundation platform and the cleats are maintained in the ground by the weight of the building structure, a diagonal strut mounted at its lower end to said foundation platform having a length sloped upwardly for connection at its upper end to a joist of the building structure so that movement of the joist of the building structure is imparted to the strut, at least one of said cleats walls oriented transverse to the length of said strut, so that the horizontal force applied from the strut to the foundation platform is resisted by said one cleat without the application of horizontal force to the pier.

26. The stabilization system of claim 25, wherein said at least one cleat wall comprises a plurality of cleat walls, and the weight of the building is sufficient to hold said cleat walls in the ground in opposition to the forces applied by the strut to the foundation platform.

* * * * *

UNITED STATES PATENT AND TRADEMARK OFFICE

CERTIFICATE OF CORRECTION

PATENT NO. : 6,546,686 B2
APPLICATION NO. : 09/772547
DATED : April 15, 2003
INVENTOR(S) : Charles J. MacKarvich It is certified that error appears in the above-identified patent and that said Letters Patent is hereby corrected as shown below:

Title Page;
The Related U.S. Application Data in column 1 of the cover page of the patent is amended to:

(63) -- Continuation-in-part of application No. 09/736,819 filed on Dec. 13, 2000, now Pat. No. 6,318,032 issued Nov. 20, 2001, which is a continuation of application No. 09/519,698 filed Mar. 7, 2000, now Pat. No. 6,243,998 issued Jun. 12, 2001, which is a continuation of application No. 09/123,806 filed Jul. 27, 1998, now Pat. No. 6,058,663 issued May 9, 2000, which is a continuation-in-part of application No. 08/739,717 filed Oct. 29, 1996, now Pat. No. 5,850,718 issued Dec. 22, 1998, which is a continuation-in-part of application No. 08/644,069 filed May 9, 1996, now Pat. No. 5,784,844 issued Jul. 28, 1998, which is a continuation-in-part of 08/629,834 filed Apr. 10, 1996, now Pat. No. 5,697,191 issued Dec. 16, 1997. --

Signed and Sealed this

Twenty-fifth Day of December, 2007

JON W. DUDAS
*Director of the United States Patent and Trademark Office*